US009289885B2

(12) United States Patent
Kobayashi

(10) Patent No.: US 9,289,885 B2
(45) Date of Patent: Mar. 22, 2016

(54) RATCHET WRENCH HAVING AN END CAP

(71) Applicant: SP AIR KABUSHIKI KAISHA, Nagano (JP)

(72) Inventor: Shigeki Kobayashi, Nagano (JP)

(73) Assignee: SP Air Kabushiki Kaisha, Kamiminochi-gun, Nagano (JP)

( * ) Notice: Subject to any disclaimer, the term of this patent is extended or adjusted under 35 U.S.C. 154(b) by 392 days.

(21) Appl. No.: 13/835,571

(22) Filed: Mar. 15, 2013

(65) Prior Publication Data

US 2014/0260834 A1 Sep. 18, 2014

(51) Int. Cl.
*B25B 21/00* (2006.01)
*B25B 21/02* (2006.01)

(52) U.S. Cl.
CPC ..... *B25B 21/004* (2013.01); *B25B 21/005* (2013.01); *B25B 21/02* (2013.01)

(58) Field of Classification Search
CPC ..... B25B 21/004; B25B 21/005; B25B 21/02
USPC ..... 81/57.13, 464
See application file for complete search history.

(56) References Cited

U.S. PATENT DOCUMENTS 4,201,099 A * 5/1980 Junkers ..... 81/57.39
4,346,630 A 8/1982 Hanson
4,821,611 A 4/1989 Izumisawa
8,166,852 B2 5/2012 Cheng
8,261,849 B2 9/2012 Kobayashi
2005/0076745 A1* 4/2005 Chen ..... 81/57.39
2005/0211026 A1* 9/2005 Cheng ..... 81/57.39
2010/0101815 A1* 4/2010 Kobayashi ..... 173/112
2011/0036209 A1* 2/2011 Hung ..... 81/60

OTHER PUBLICATIONS

Internet publication, Amazon.com listing, KET 1150 Railhead Corporation (K&E Tools) 3/8 Drive High SPeed Reaction-Free Mini Air Ratchet, pre-Jun. 2012.*
Railhead Corporation KE-1140/KE-1150 parts breakdown, Part 49, Internet Publication, http://www.railheadcorp.com/filebin/pdf/KE-1140_1150_Breakdown.pdg.*

* cited by examiner

*Primary Examiner* — Bryan R Muller
(74) *Attorney, Agent, or Firm* — Senniger Powers LLP

(57) ABSTRACT

A power driven tool for rotating a mechanical element includes a housing including a base and a head connected to the base. The head has a yoke formed by opposing arms separated by an opening. A selectively operable motor is positioned in the housing having an output shaft that rotates relative to the housing during operation of the motor. A ratchet mechanism is mounted in the housing and includes an output drive at least partially mounted in the opening for rotation relative to the housing to rotate the mechanical element in a selected direction. A cap is positioned on the head of the housing across the opening forming the yoke. The cap reinforces the yoke during operation of the tool to prevent the arms from separating and blocking at least part of the opening between the arms to prevent debris from entering the ratchet mechanism.

17 Claims, 17 Drawing Sheets

RATCHET WRENCH HAVING AN END CAP

BACKGROUND OF THE INVENTION

This invention relates generally to power driven tools, and more particularly, to a power driven tool for tightening or loosening fasteners including a ratchet mechanism and an end cap. Examples of power driven ratchet wrenches are disclosed in co-owned U.S. Pat. Nos. 4,821,611 and 8,261,849, which are incorporated by reference.

Although configurations vary, ratchet wrenches usually have a drive element rotatably mounted in a yoke. The drive element is operatively connected to a motor that selectively rotates the drive element to tighten or loosen fasteners. Some of these ratchet wrenches also include an impact mechanism connecting the motor to the drive element that imparts an impact to the drive element under high load conditions such as may occur when a seized fastener is being loosened. The yoke that holds the drive element is formed by a pair of spaced, cantilevered plates or arms. The drive element positioned in the space or opening between the plates usually is exposed around its entire circumferential surface except where the plates connect to the ratchet body.

Frequently, when dirt and debris comes in contact with the exposed surface, the drive element pulls the dirt and debris into the interior of the ratchet wrench. Once inside the wrench, the dirt and debris can cause wear between internal moving parts of the wrench. Worse, the dirt and debris can cause the wrench to jam. Further, under high loads forces inside the wrench can act to spread the plates that form the yoke. Spreading is undesirable. Thus, there is a need for a way to prevent yoke spreading, as well as to guard against dirt and debris entering the wrench.

SUMMARY OF THE INVENTION

In one aspect, a power driven tool for rotating a mechanical element generally comprises a housing including a base and a head connected to the base. The head has a yoke formed by opposing arms separated by an opening. A selectively operable motor is positioned in the housing having an output shaft that rotates relative to the housing during operation of the motor. A ratchet mechanism is mounted in the housing and includes an output drive at least partially mounted in the opening between the opposing arms of the head for rotation relative to the housing to rotate the mechanical element in a selected direction. A cap is positioned on the head of the housing across the opening forming the yoke. The cap reinforces the yoke during operation of the tool to prevent the arms from separating and blocking at least part of the opening between the arms to prevent debris from entering the ratchet mechanism.

In another aspect, a power driven tool for tightening and loosening a mechanical fastener generally comprises a housing having front and back ends spaced along a longitudinal axis. A ratchet mechanism is mounted in the housing and includes an output drive rotatably mounted at the front end of the housing for operatively engaging the mechanical fastener. A motor is positioned in the housing and has an output shaft. An impact mechanism is positioned in the housing and operatively connects the motor and the output drive. A cap is positioned on the front end of the housing to reinforce the front end during operation of the tool.

In yet another aspect, a pneumatic tool for tightening and loosening a mechanical fastener generally comprises n elongate tubular housing sized for being manually held. A pneumatic motor in the housing has an output shaft adapted for rotation. An impact mechanism within the housing operatively connects to the motor output shaft. A ratchet mechanism operatively connects to the impact mechanism. The ratchet mechanism includes an output drive mounted for rotation relative to the housing for rotating the mechanical fastener in a selected direction. A cap is positioned on the housing. The cap reinforces the housing during operation of the tool.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
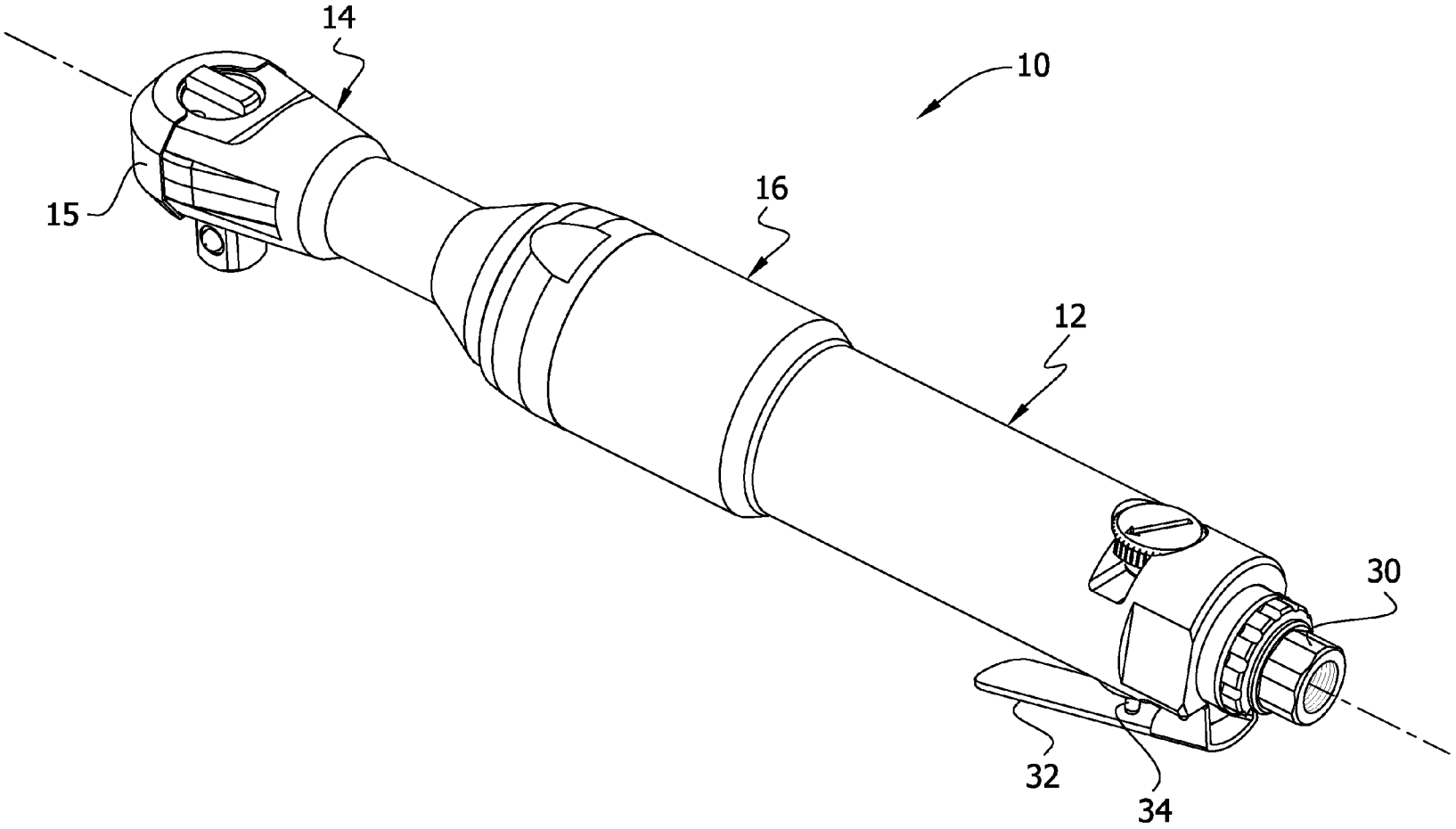
FIG. 1 is a perspective of a hand-held pneumatic ratchet wrench of the invention incorporating an impact drive and pneumatic motor.
Figure 2:
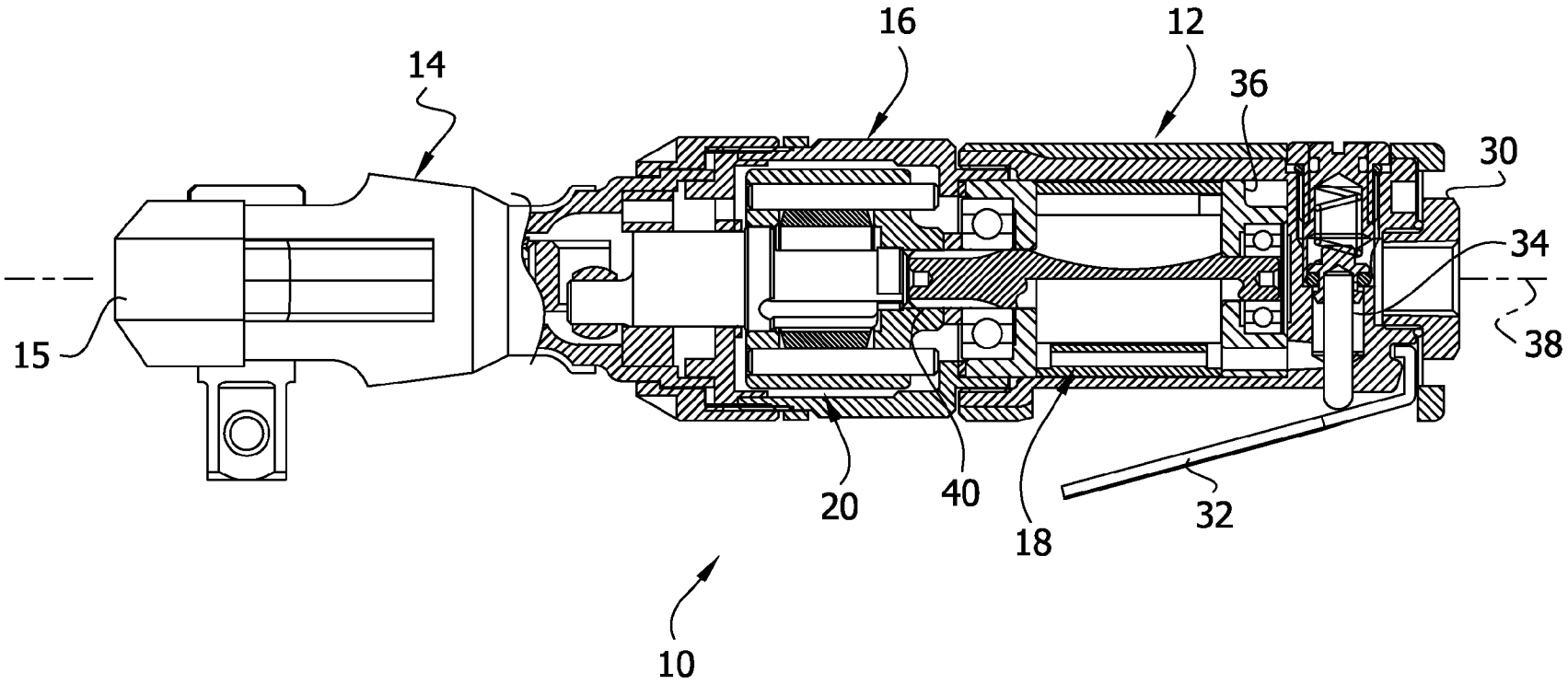
FIG. 2 is an elevation of the wrench of FIG. 1 in partial section to show internal construction.

Referring now to the drawings, and particularly to FIGS. 1 and 2, a hand held, pneumatically-driven, ratchet wrench is indicated in its entirety by reference numeral 10. The wrench 10 includes a tubular grip or base, generally designated 12, and a head, generally designated 14. An end cap (or, more precisely, a U-shaped cap) 15 is positioned on the head 14. As shown in FIG. 2, the grip 12 and head 14 are connected by a tubular threaded coupling, generally designated 16, so the grip, coupling, head, and end cap 15 form a housing that houses the functional components of the wrench 10. The grip 12 houses a motor, generally designated 18. An impact drive, generally designated 20, is positioned inside the coupling 16, and a ratchet mechanism, generally designated 22 (FIG. 5), is provided in the head 14 and end cap 15. Each of these components will be described in greater detail below. For convenience of description, when describing orientations of components, forward will be understood to be toward an end of the wrench 10 having the head 14 and end cap 15.

Referring to FIG. 1, an air inlet fitting 30 provided at a rearward end of the grip 12 is capable of connecting the wrench 10 to a conventional external pressurized air source (not shown). A lever 32 provided adjacent the grip 12 controls fluid flow to the motor 18. The lever 32 is pivotally mounted on the grip 12 and is spring biased toward a position in which a free end of the lever is laterally displaced away from the grip as shown so that it can be squeezed toward the grip to open a valve 34 to selectively permit pressurized air to flow through the air inlet fitting 30 to the motor 18. As shown in FIG. 2, the motor 18 includes a rotor 36 rotatably mounted on the grip 12 for rotation about a centerline 38. The rotor 36 rotates in response to air passing through the motor 18 when the valve 34 is open. The rotor 36 includes an output shaft 40 centered on the centerline 38. Although the output shaft 40 may has other shapes without departing from the scope of the present, in one embodiment the shaft has a generally cylindrical, splined (i.e., ridged) exterior for connecting the shaft to the impact drive. The motor 18 illustrated and described is a standard, air-driven motor of the type commonly used in pneumatic tools. Because the motor 18 is conventional, it will not be described in further detail.

Figure 3:
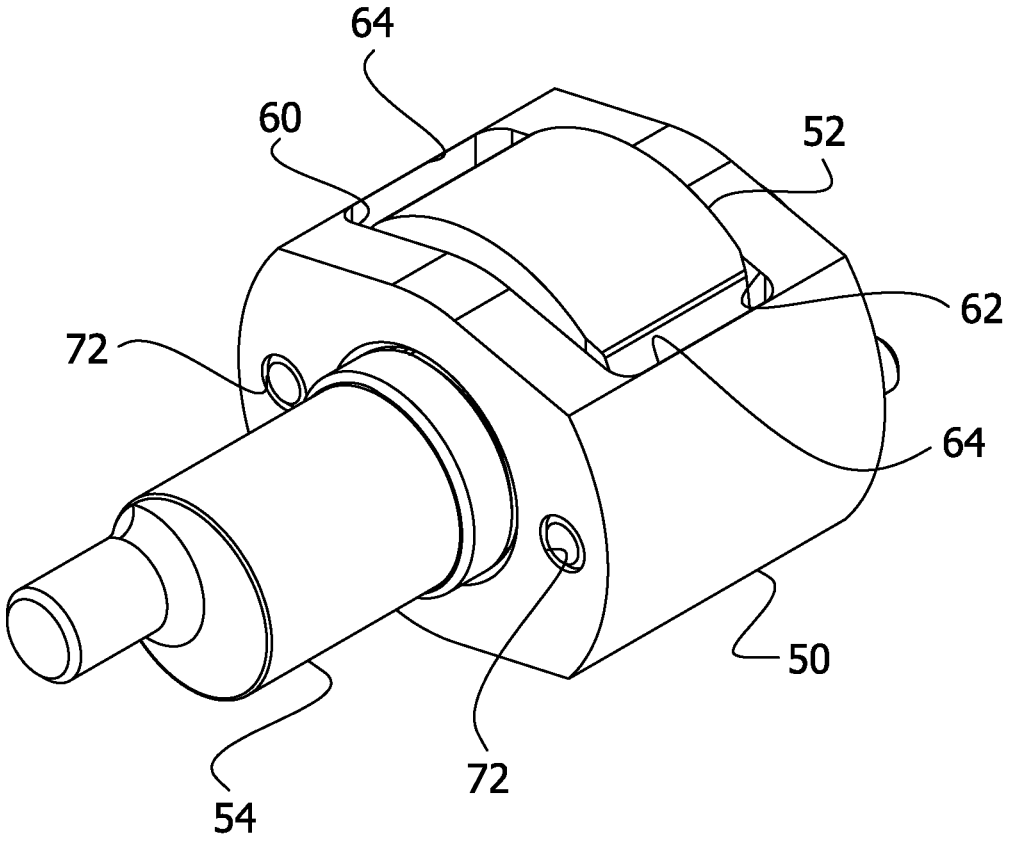
FIG. 3 is a perspective of an impact drive of the wrench.
Figure 4:
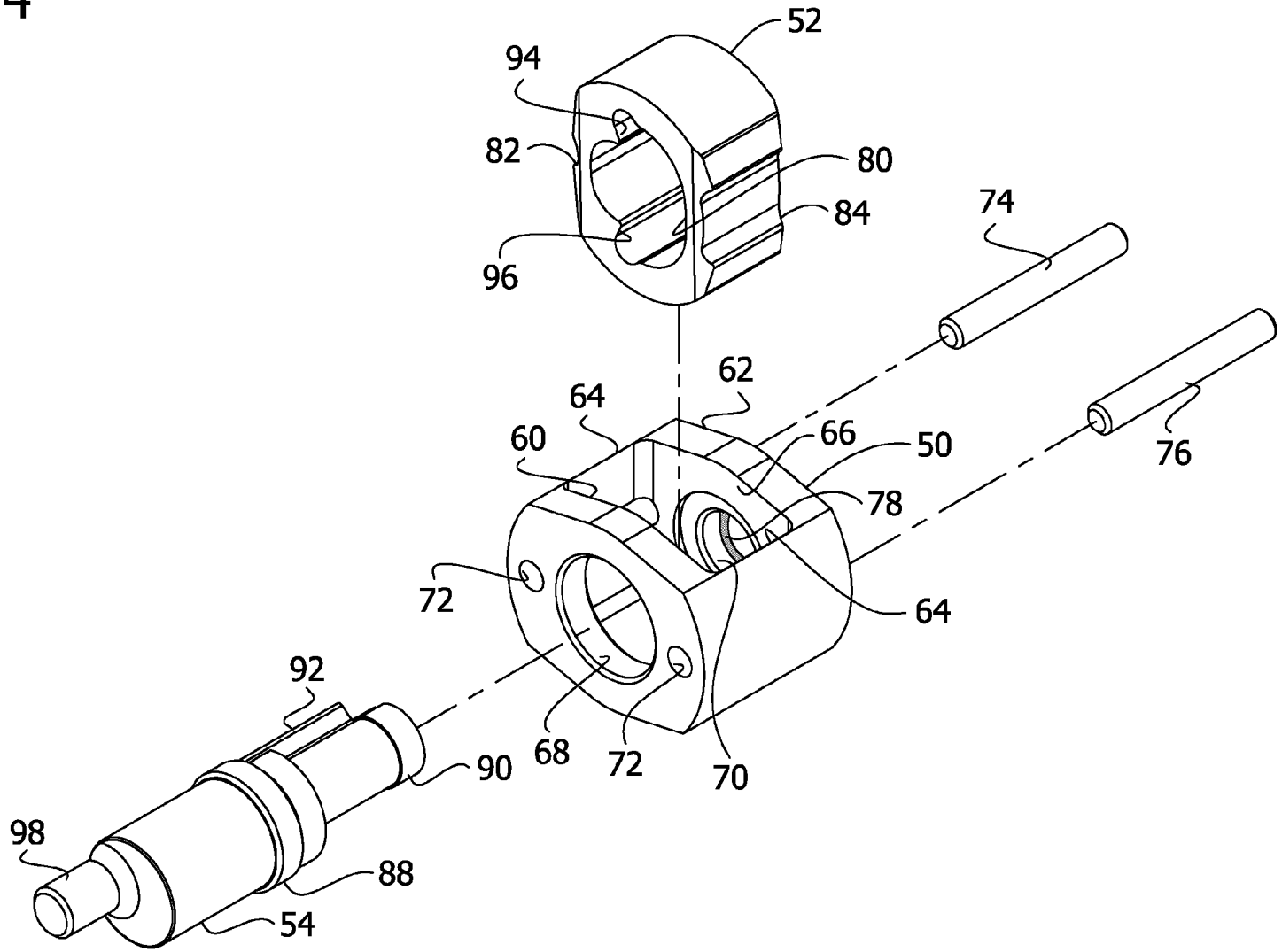
FIG. 4 is a separated perspective of the impact drive.

As illustrated in FIGS. 3 and 4, the impact drive 20 of the wrench 10 generally comprises a clutch base 50, a hammer 52, and an anvil shaft 54. As further illustrated in FIG. 4, the base 50 includes forward and rearward bushing plates 60, 62, respectfully, separated by integral spacers 64 creating a space 66 between the plates for receiving the hammer 52. Each of the bushing plates 60, 62 includes a respective machined central opening 68, 70 for receiving the shaft 54. Holes 72 are provided on opposite sides of the openings 68, 70 for receiving pins 74, 76 that capture the hammer 52 in the space 66 formed between the plates 60, 62. A portion 78 of the rearward central opening is 68 splined for receiving the splined output shaft 40 of the motor 18. Thus, the base 50 turns with the motor rotor 36. The hammer 52 includes a lobed central opening 80, a semi-circular slot 82 on one side and a broad slot 84 on an opposite side. The slots 82, 84 receive the pins 74, 76 so they extend between the plates 60, 62 for retaining the hammer 52 in the space 66. As will be appreciated by those skilled in the art, the semi-circular slot 82 and the pin 74 permit the hammer 52 to pivot. The broad slot 84 and pin 76 limit rotation of the hammer 52 as it pivots on pin 74. The anvil shaft 54 extends through the central openings 68, 70 of the bushing plates 60, 62 and the lobed central opening 80 of the hammer 52. The shaft 54 also has spaced journals 88, 90 corresponding to the central openings 68, 70 in the plates 60, 62. The journals 88, 90 engage the central openings 68, 70 for supporting the shaft 54 and permitting the shaft to rotate in the base 50. An anvil 92 is provided on the shaft 54 between the journals 86, 88 so lands 94, 96 in the lobed opening 80 of the hammer 52 can intermittently engage the anvil to provide increased torque as will be explained in greater detail below. In addition, the shaft 54 includes a crank 98 at its forward end for driving the ratchet mechanism 22.

Figure 5:
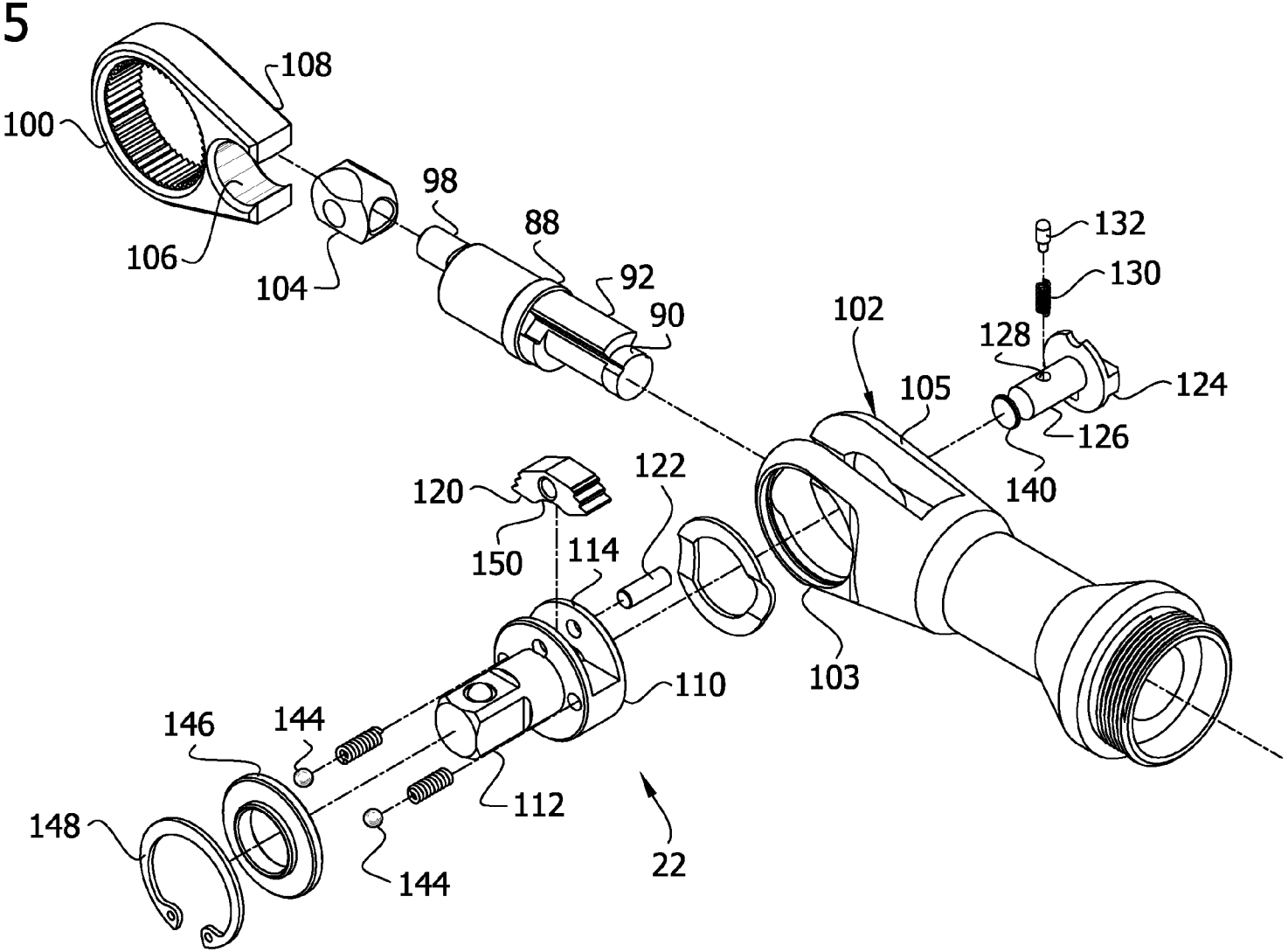
FIG. 5 is a separated perspective of a ratchet mechanism of the wrench.

FIG. 5 illustrates the ratchet mechanism 22 of the wrench 10 which converts orbital motion of the crank 98 to rotational motion in a selected direction. The crank 98 drives an internal ring gear or oscillatory member 100 to oscillate back and forth in a yoke 102 of the head 14. The ring gear 100 is positioned between opposing sides 103, 105 of the yoke 102. The crank 98 and ring gear 100 are operationally connected by a bushing 104 that is received in a generally cylindrical opening 106 of an arm 108 extending from the ring gear. A drive body 110 is rotatably mounted inside the ring gear 100. The drive body 110 includes square output drive 112 and a dog carrier 114. A pivotal ratchet dog or ratchet pawl 120 is pivotally captured in the dog carrier 114 by a pin 122. The dog 120 is biased to pivot in one selected direction by a selector knob 124. The selector knob 124 includes a shaft 126 that extends inside the dog carrier 114. The shaft 126 has a recess 128 that holds a spring 130 for biasing a pusher 132 against the dog 120. The pusher 132 pushes the dog 120 in a selected direction so the ring gear 100 drives the drive body 110 in one direction but not in the other direction as the ring gear oscillates back and forth. An axial bushing pad 140 is positioned between the shaft 126 of the selector knob 124 and the drive body 110, and a keeper 142 is positioned between the drive body and the yoke 102 of the head 14. Spring biased bearings 144 and a race 146 allow the drive body 110 to spin freely in the head 14. A snap ring 148 retains the race 146 in position in the head 14. The illustrated ratchet mechanism 22 is similar to that shown in U.S. Pat. No. 4,346,630, generally including an output drive 112 rotatably mounted on the head 14 for engaging a mechanical fastener or other mechanical element.

The ratchet mechanism 22 selectively limits rotation of the output drive 112 in one direction. It may be seen that by manually rotating the selector knob 124, the shaft 126 can be rotated, which rotates the pusher 132 within a channel 150 of the dog 120. In a first position, the dog 120 is positioned to be rotated by the ring gear 100 in one direction (e.g., clockwise). In a second position, the dog 120 is positioned to be rotated by the ring gear 100 in the opposite direction (e.g., counterclockwise). Each end of the dog 120 operates only in one direction, and is free to move in a direction opposite that direction. Because the ratchet mechanism 22 is conventional, it will not be described in further detail. It is envisioned that the ratchet mechanism 22 may have a dual or double pawl configuration. For convenience of description, when describing orientations of components, a bottom of the wrench 10 will be understood to be a direction in which the drive body 110 extends from the head 14.

Figure 6:
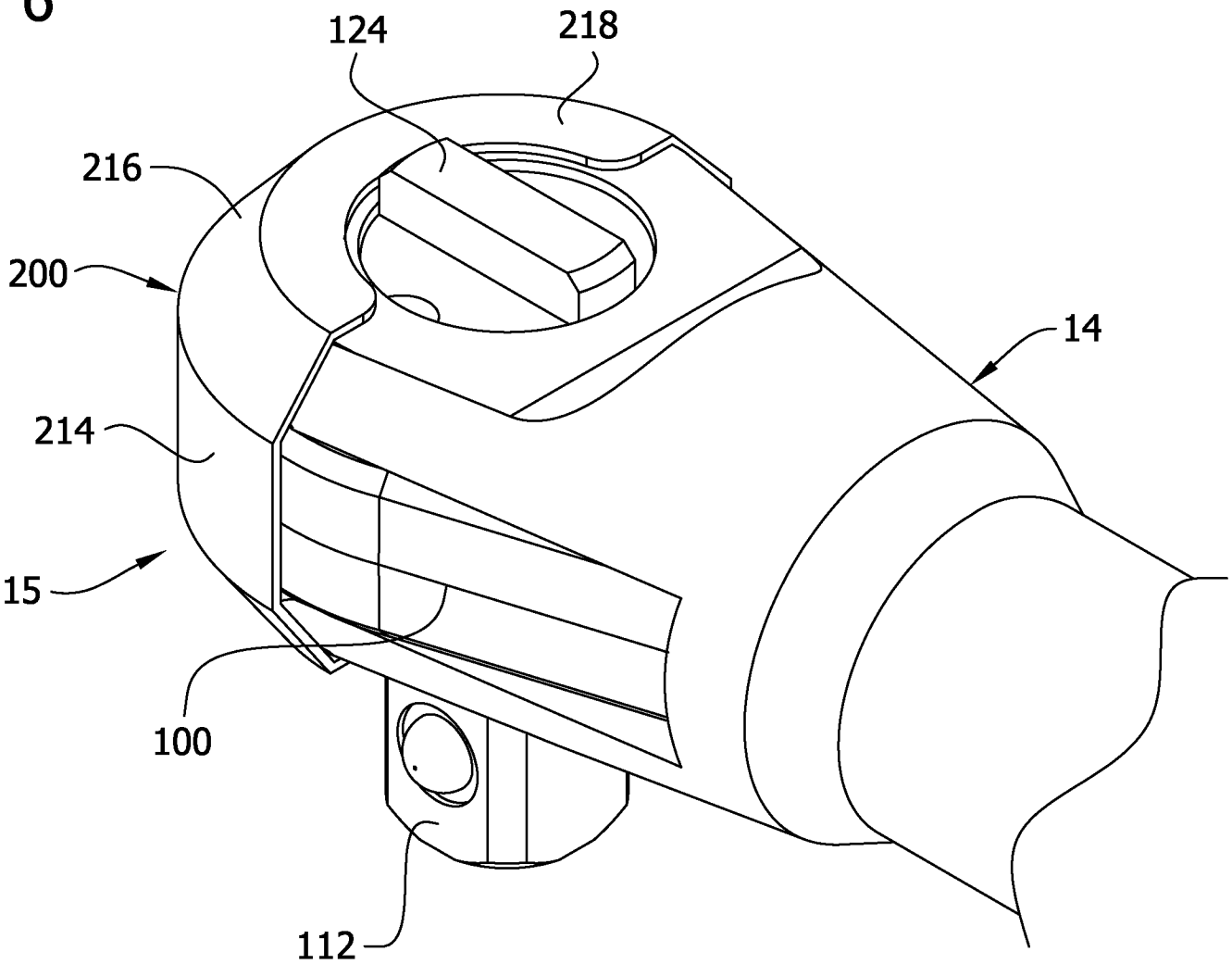
FIG. 6 is an enlarged fragmentary rear perspective of a head of the wrench with an end cap mounted on the head.
Figure 7:
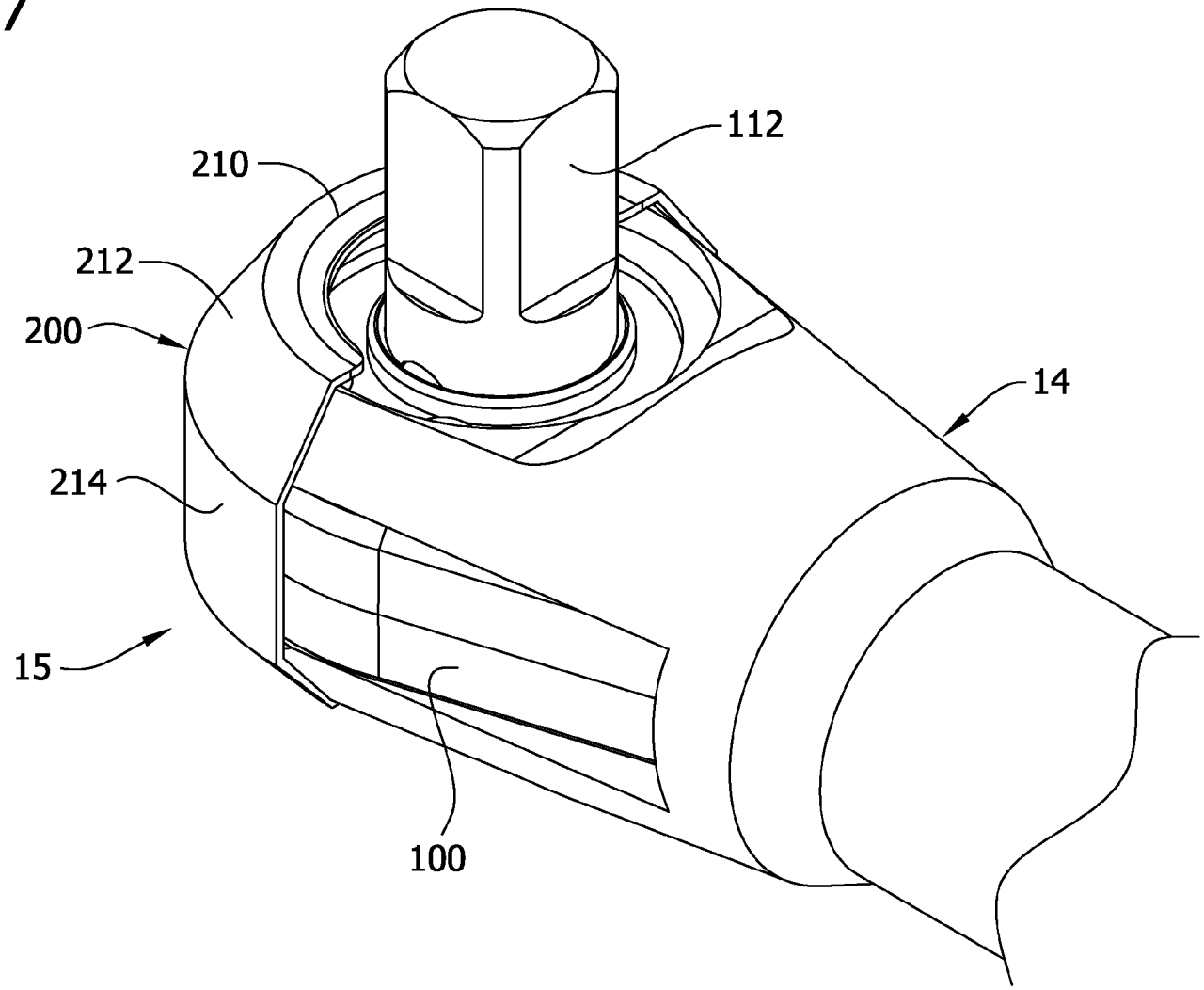
FIG. 7 is a front perspective of the head and end cap of FIG. 6
Figure 8:
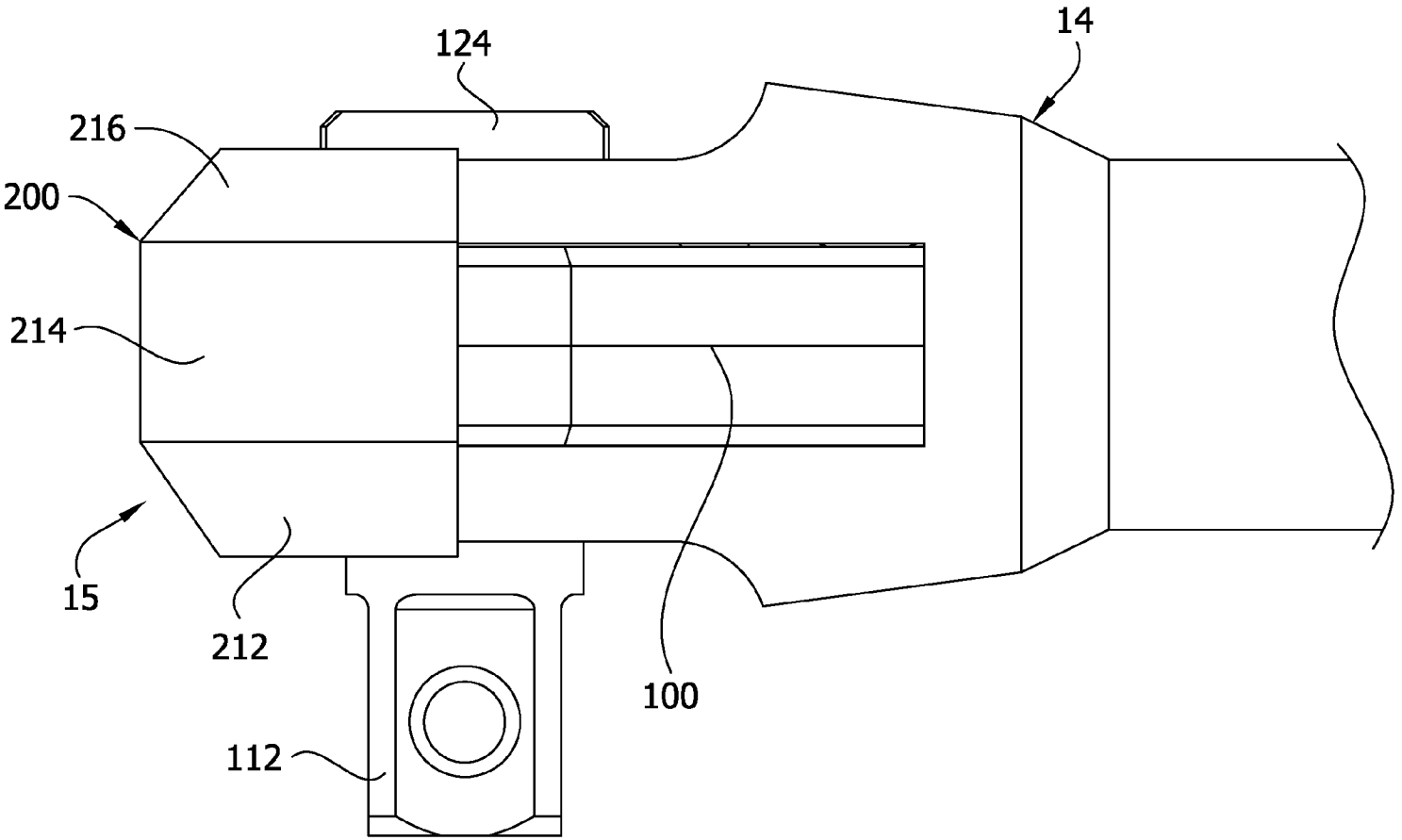
FIG. 8 is a side view of the head and end cap of FIG. 6.
Figure 9:
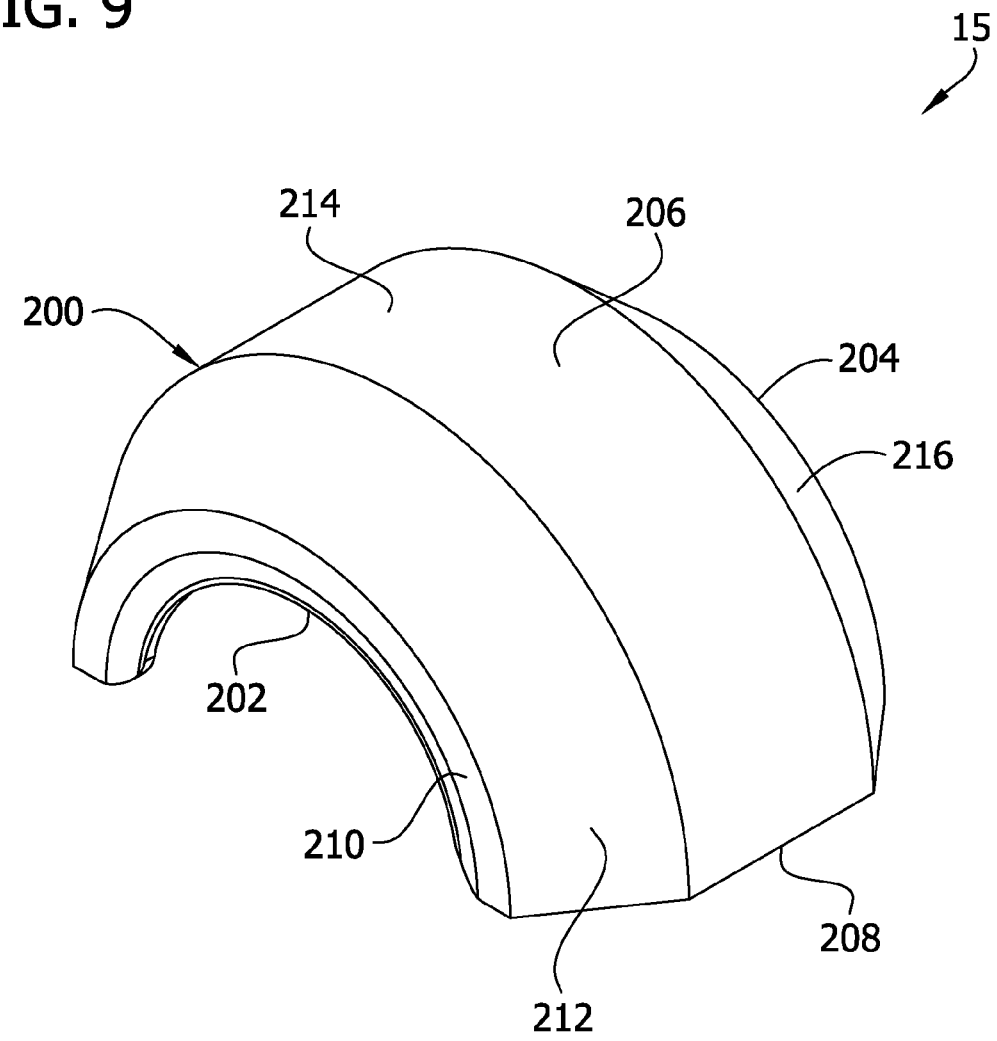
FIG. 9 is a perspective of the end cap.
Figure 10:
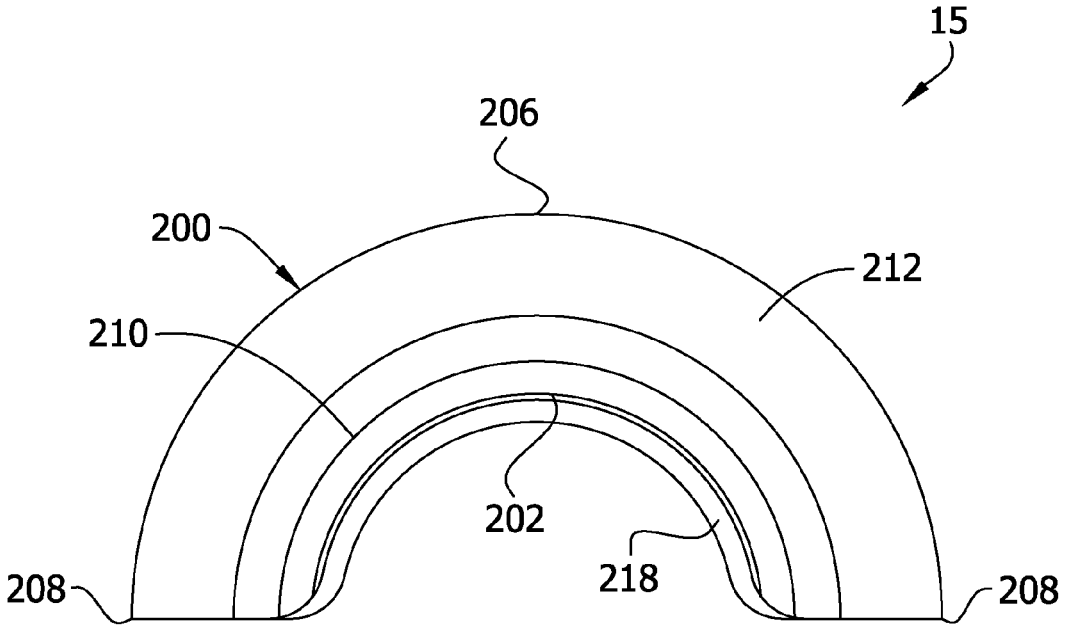
FIG. 10 is a front view of the end cap.
Figure 11:
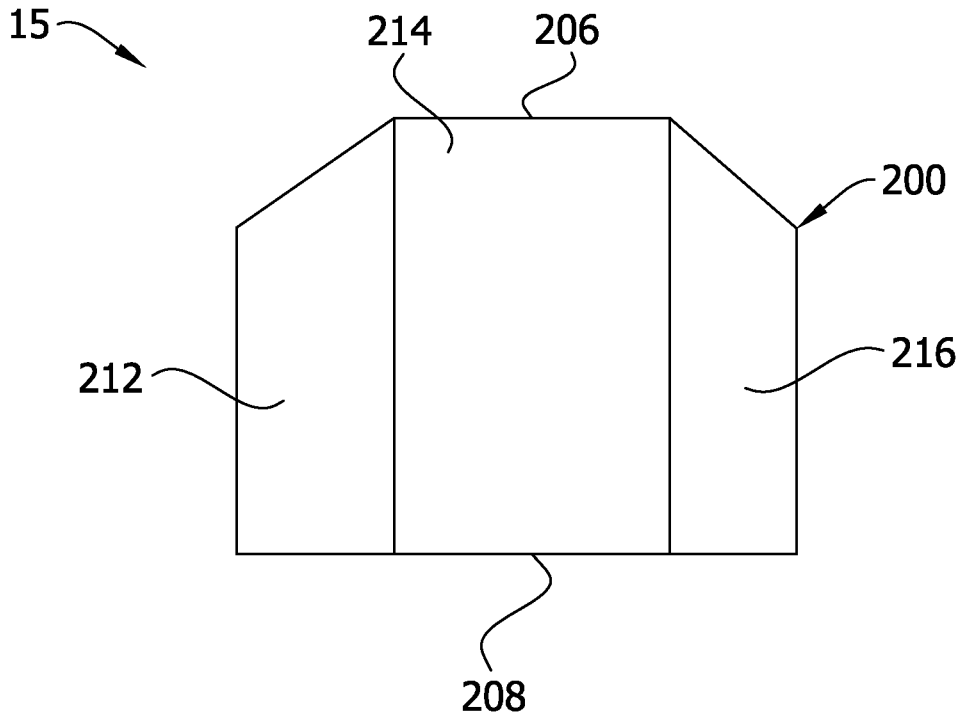
FIG. 11 is a right side view of the end cap.
Figure 12:
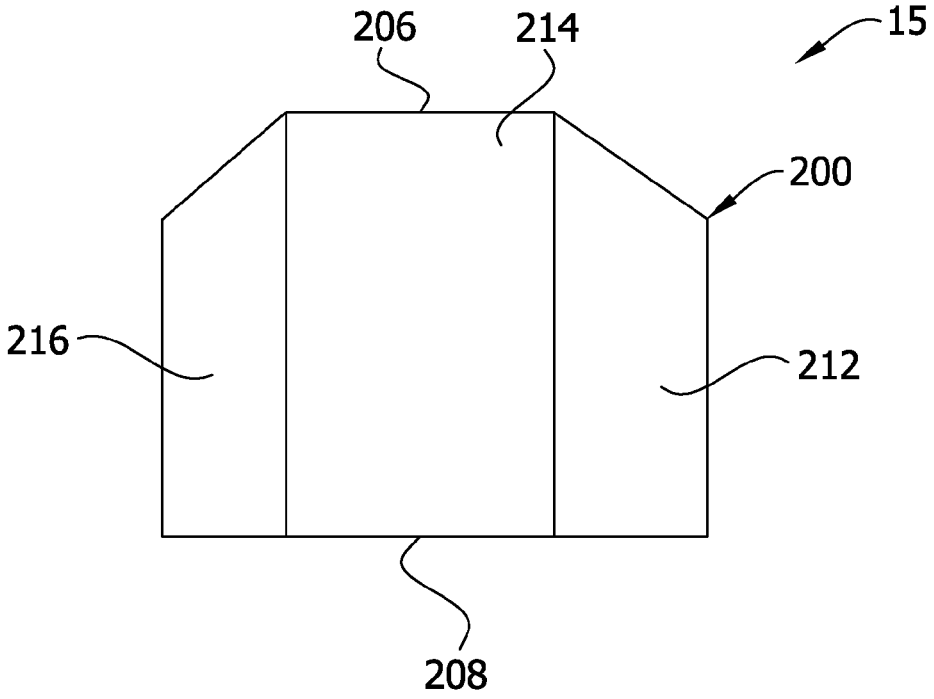
FIG. 12 is a left side view of the end cap.
Figure 13:
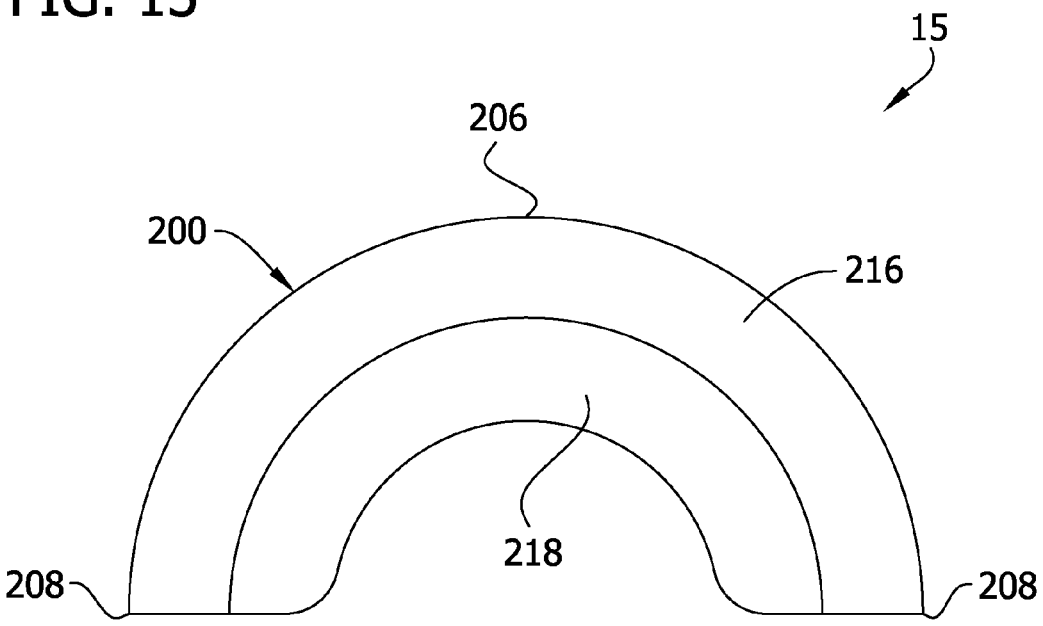
FIG. 13 is a back view of the end cap.
Figure 14:
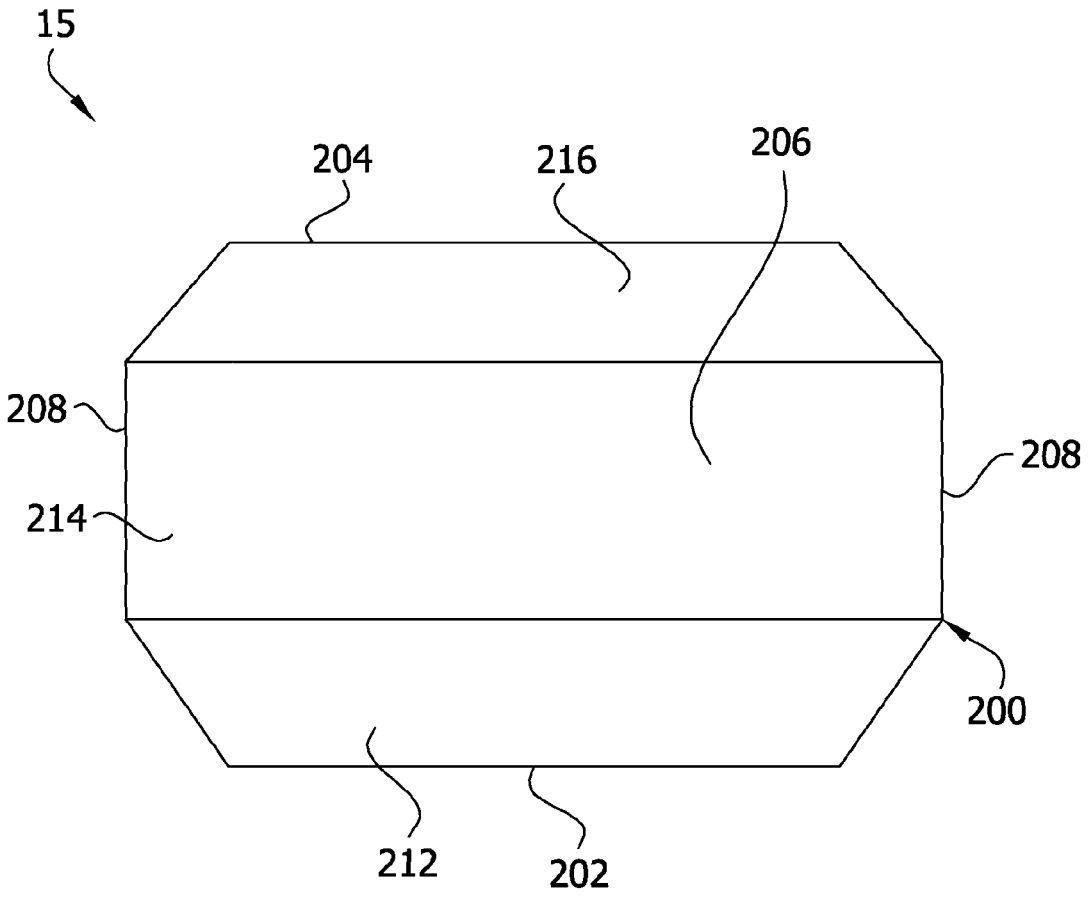
FIG. 14 is a top view of the end cap.
Figure 15:
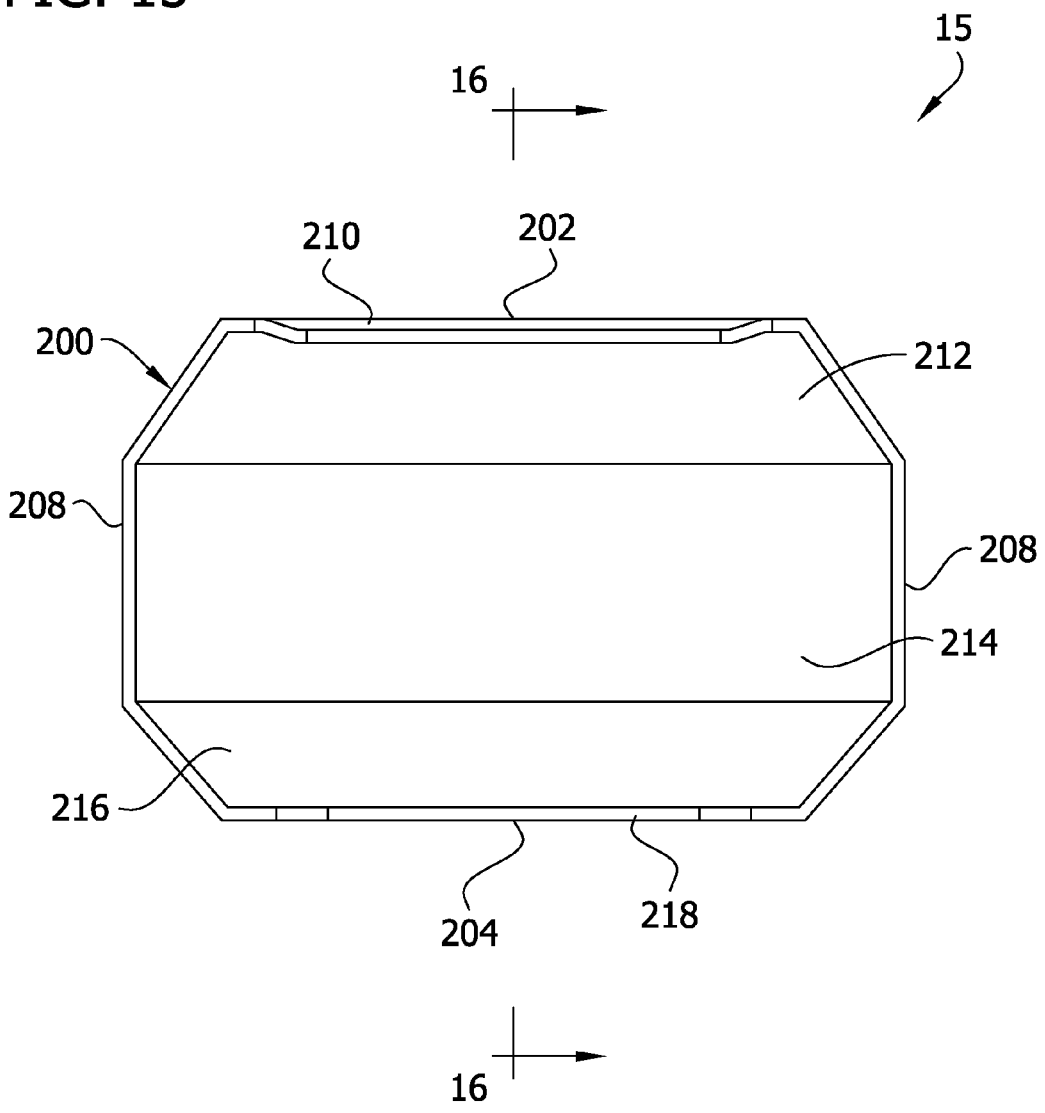
FIG. 15 is a bottom view of the end cap.
Figure 16:
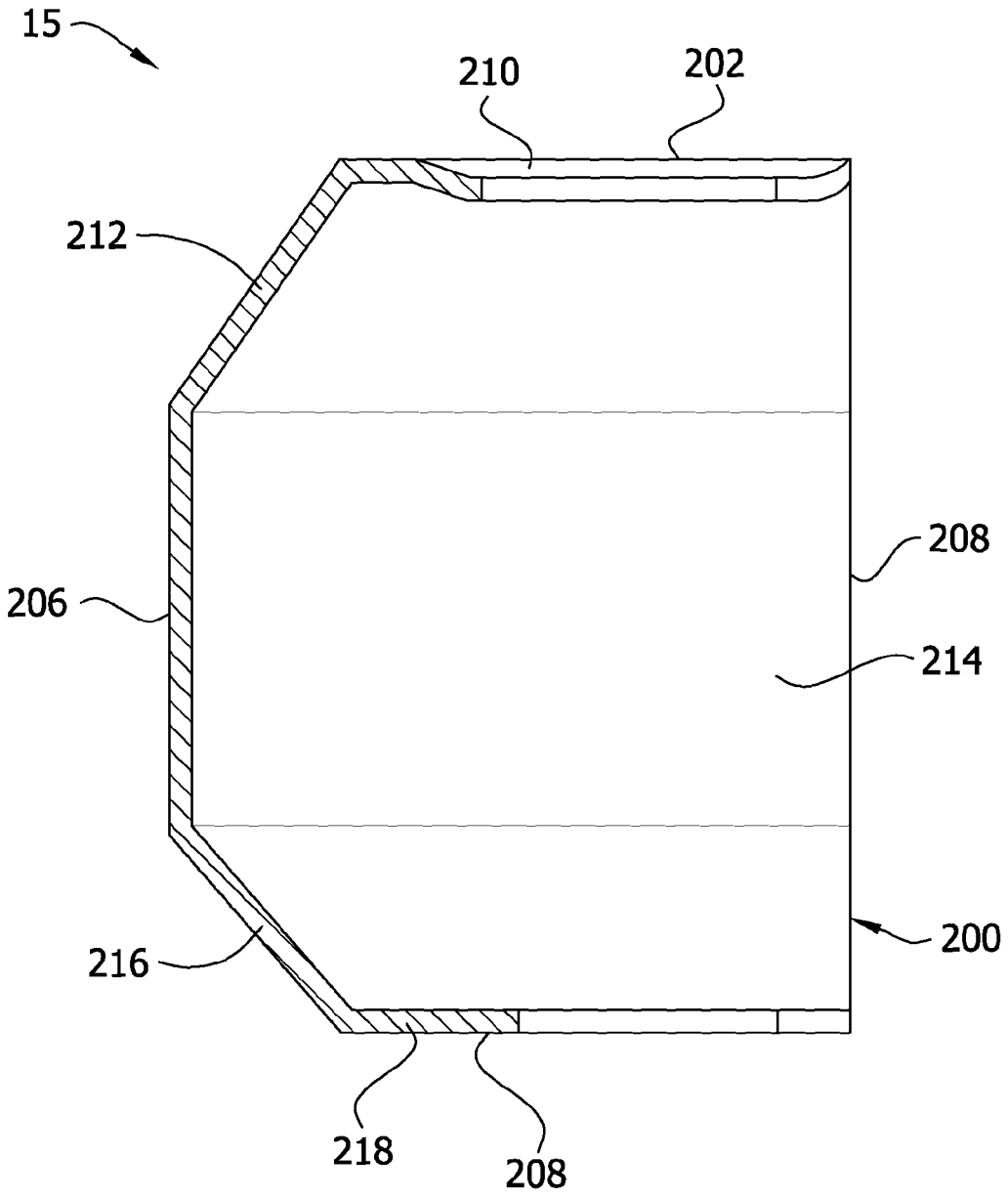
FIG. 16 is a section of the end cap taken through line 16-16 in FIG. 15.

Referring to FIGS. 6-16, the end cap 15 comprises an arcuate body 200 including a bottom 202, a top 204, a front 206, and opposite sides 208. The arcuate body 200 has a plurality of integrally-formed, arcuate segments extending between the opposite sides 208 of the body. A first or bottom arcuate segment 210 is positioned generally at the bottom 202 of the body 200 in use. A second arcuate segment 212 extends forward and upward from a forward edge of the first arcuate segment 210 in use. A third, middle, or front arcuate segment 214 extends upward from an upper edge of the second arcuate segment 212. The third arcuate segment 214 is positioned generally at the front 206 of the body 200 in use. A fourth arcuate segment 216 extends upward and rearward from an upper edge of the third arcuate segment 214 in use. A fifth or top arcuate segment 218 extends rearward from an upper edge of the fourth arcuate segment 216. The fifth arcuate segment 218 is positioned generally at the top 204 of the body 200 in use. As shown in FIG. 6, the bottom segment 210 is frustoconic so a rearward edge of the segment extends inward toward the snap ring 148. As shown in FIG. 9, the top segment 218 is planar to provide clearance for accessing the selector knob 124.

Figure 17:
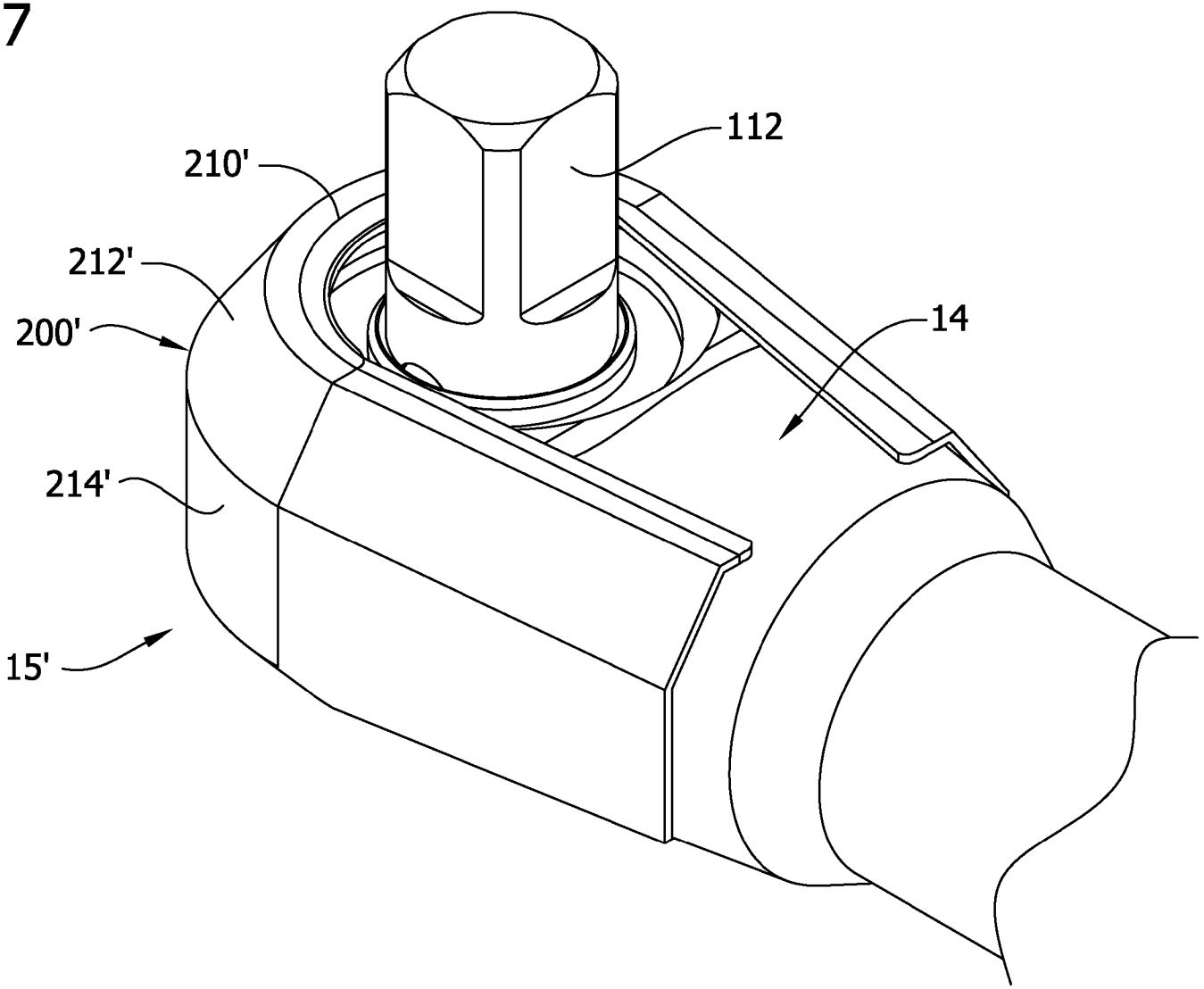
FIG. 17 is an enlarged fragmentary perspective of a wrench having an end cap of a second embodiment mounted on a head of the wrench.

Referring to FIGS. 1, 2, and 6-8, the end cap 15 is positioned on the head 14 of the wrench 10 such that it extends between the opposing sides 103, 105 of the yoke 102 and works to prevent the sides from spreading. Thus, under high load situations, when the ring gear 100 may apply forces to the sides 103, 105 in a way that tends to spread the yoke, the cap 15 reinforces the yoke and prevents the sides from spreading. The end cap 15 also covers the front end of the yoke 102 of the head 14 where part of the ring gear 100 would otherwise be exposed. When the wrench 10 is set down, the front end of the wrench sometimes contacts the shop floor or ground first. Without the end cap 15, the ring gear 100 would contact the floor or ground in these situations, collecting dirt and debris. The collected dirt and debris can be pulling inside the head 14 as the ring gear 100 subsequently rotates, causing wear between parts within the housing. Because the cap 15 covers the forward end of the yoke, the ring gear 100 is less likely to collect dirt and debris. Thus, the cap 15 reduces potential wear within the wrench 10. In one embodiment, the end cap 15 may be formed from steel sheet and press fit onto the head 14 of the wrench 10. The end cap 15 is mounted on the head 14 of the wrench 10 such that it covers generally a front half of the head. It is envisioned that in an alternative embodiment, the end cap 15' could extend rearward along the sides of the ring gear 100 to cover substantially all of the ring gear (FIG. 17).

During operation of the wrench 10, air enters through the air inlet fitting 30 at the rearward end of the grip 12 when the lever 32 is squeezed toward the grip. The air enters the motor 18 where it rotates the rotor 36 including the output shaft 40. The motor shaft 36 rotates the clutch base 50. When required torque is low, the clutch base 50 turns the hammer 52 which engages the anvil 92 to turn the shaft 54. The crank 98 orbits the wrench centerline 38, oscillating the ring gear 100. As the ring gear 100 oscillates in one direction, the dog 120 pivots into the dog carrier 114 so the output drive 112 does not turn. As the gear 100 oscillates in another direction, the dog 120 engages the gear so the output drive 112 turns with the gear. When the required torque exceeds some preselected value, the hammer 52 pivots on the pin 74, disengaging the engaged hammer land 94 or 96 from the anvil 92 on the shaft 54 and temporarily preventing the crank 98 from driving the ratchet mechanism 22. After the anvil 92 passes the hammer land 94 or 96, the hammer 62 pivots back to a position in which the land engages the anvil 92 on the next revolution. When the combined spinning mass of the motor rotor 36, base 60, and hammer 52 acts through the hammer to impact the anvil 92 on the next revolution, an instantaneous torque increase occurs. The torque increase acts to overcome the friction in the mechanical fastener. If the torque exceeds the preselected value on the next revolution the sequence repeats. Otherwise, the impact drive 20 delivers continuous torque.

Components of the wrench of this invention may be made of a suitable material, such as metal (e.g., cold-forged steel).

When introducing elements of the present invention or the preferred embodiments(s) thereof, the articles "a", "an", "the", and "said" are intended to mean that there are one or more of the elements. The terms "comprising", "including", and "having" are intended to be inclusive and mean that there may be additional elements other than the listed elements.

In view of the above, it will be seen that the several objects of the invention are achieved and other advantageous results attained.

As various changes could be made in the above construction without departing from the scope of the invention, it is intended that all matter contained in the above description and shown in the accompanying drawings shall be interpreted as illustrative and not in a limiting sense.

What is claimed is:

1. A power driven tool for rotating a mechanical element, the tool comprising:

a housing including a base and a head connected to the base, the head having a yoke formed by opposing planer arms extending parallel to each other and being separated by an opening, each of said arms including an outer surface facing away from the other arm;

a selectively operable motor positioned in the housing having an output shaft that rotates relative to the housing during operation of the motor;

a ratchet mechanism mounted in the housing and including an output drive at least partially mounted in the opening between the opposing arms of the head for rotation relative to the housing to rotate the mechanical element in a selected direction; and a U-shaped metal cap positioned on the head of the housing across the opening forming the yoke and simultaneously engaging the outer surface of each arm of the yoke, the cap reinforcing the yoke during operation of the tool to prevent the arms from separating and blocking at least part of the opening between the arms to prevent debris from entering the ratchet mechanism.

2. A power driven tool as set forth in claim 1, further comprising an impact mechanism mounted within the housing and operatively connected between the motor output shaft and the ratchet mechanism to impart an instantaneous torque on the output drive.

3. A power driven tool as set forth in claim 1, wherein the cap covers a front half of the opening forming the yoke.

4. A power driven tool as set forth in claim 3, wherein the cap covers the opening forming the yoke.

5. A power driven tool as set forth in claim 3, wherein the cap has a shape generally corresponding to an outer surface of the yoke.

6. A power driven tool as set forth in claim 1, wherein the ratchet mechanism comprises an oscillatory member configured to oscillate back and forth to drive rotation of the output drive, the cap covering at least a portion of the oscillatory member.

7. A power driven tool as set forth in claim 1, wherein the cap comprises an arcuate member.

8. A power drive tool as set forth in claim 7, wherein the arcuate member comprises a plurality of adjoining arcuate segments.

9. A power driven tool as set forth in claim 1, wherein the cap comprises steel.

10. A power driven tool as set forth in claim 9, wherein the cap has an interference fit with the head of the housing.

11. A power driven tool as set forth in claim 1, wherein the motor is a pneumatic motor.

12. A power driven tool for tightening and loosening a mechanical fastener, the tool comprising:

a housing having front and back ends spaced along a longitudinal axis, and including a base and a head connected to the base, the head having a yoke formed by opposing planer arms extending parallel to each other and being separated by an opening, each of said arms including an outer surface facing away from the other arm;

a ratchet mechanism mounted in the housing and including an output drive rotatably mounted at the front end of the housing for operatively engaging the mechanical fastener;

a motor positioned in the housing having an output shaft;

an impact mechanism positioned in the housing and operatively connecting the motor and the output drive; and a U-shaped metal cap positioned on the front end of the housing and simultaneously engaging the outer surface of each arm of the yoke to reinforce the front end during operation of the tool to prevent the arms from separating.

13. A power driven tool as set forth in claim 12, wherein the output drive is positioned in the yoke.

14. A power driven tool as set forth in claim 13, wherein the output drive rotates about a transverse axis extending transverse to said longitudinal axis.

15. A power driven tool as set forth in claim 12, wherein the cap comprises steel.

16. A pneumatic tool for tightening and loosening a mechanical fastener, the tool comprising:

an elongate tubular housing sized for being manually held, and the housing including a yoke, the yoke including a pair of spaced arms, each arm having an outer surface;

a pneumatic motor in the housing having an output shaft adapted for rotation;

an impact mechanism within the housing operatively connected to the motor output shaft;

a ratchet mechanism operatively connected to the impact mechanism, the ratchet mechanism including an output drive mounted for rotation relative to the housing for rotating the mechanical fastener in a selected direction; and a U-shaped metal cap positioned on the yoke, the cap simultaneously engaging the outer surface of both arms to reinforce the yoke to prevent the arms from separating during operation of the tool.

17. A power driven tool as set forth in claim 16, wherein the cap is steel.

* * * * *